United States Patent [19]

Torp

[11] Patent Number: 4,993,648

[45] Date of Patent: Feb. 19, 1991

[54] KNIFE ASSEMBLY

[76] Inventor: Per C. Torp, Sondervang 3, DK-9640, Farso, Denmark

[21] Appl. No.: 354,798

[22] Filed: May 22, 1989

[51] Int. Cl.[5] ..... B02C 18/20

[52] U.S. Cl. ..... 241/100; 241/235; 241/292.1

[58] Field of Search ..... 241/235, 236, 282.1, 241/282.2, 292.1, 293, 294, 295, 277, 100

[56] References Cited

U.S. PATENT DOCUMENTS 4,046,324 9/1977 Chambers ..... 241/236 X
4,385,732 5/1983 Williams ..... 241/236

FOREIGN PATENT DOCUMENTS 1256002 11/1961 France ..... 241/292.1

*Primary Examiner*—Mark Rosenbaum

*Attorney, Agent, or Firm*—Hurt, Richardson, Garner, Todd & Cadenhead

[57] ABSTRACT

A knife assembly having a mounting flange defining an abutting surface and knives extending radially outwardly from the mounting flange. A first knife defines a first distal point extending in a direction circumferentially around the mounting flange. A second knife extends radially outwardly from the mounting flange and defines a second distal point extending in the same circumferential direction as the first distal point, and also defines a third distal point extending in the opposite circumferential direction as the first and second distal points. Numerous knife assemblies are spaced along inwardly, counterrotating drive shafts of an industrial refuse shredder. Material is comminuted between the inwardly counterrotating knife assemblies of the shredder.

16 Claims, 3 Drawing Sheets

KNIFE ASSEMBLY

BACKGROUND OF THE INVENTION

1. Field of the Invention

This invention relates to a knife assembly and is more particularly concerned with a knife assembly designed to be incorporated into a shredder for comminuting industrial waste and other such material.

2. Description of the Prior Art

Knife assemblies have been extensively used in comminution devices, such as shredders for industrial waste, meat cutters, ice breakers, and similar devices. These knife assemblies are usually adapted to be received on a drive shaft, which rotates to turn numerous, spaced knife assemblies about an axis. The individual knife assemblies previously employed have comprised various configurations, depending upon the material to be comminuted and the size of the desired final product. U.S. Pat. No. 4,678,126, discloses one such knife assembly and its incorporation into a shredder. The knife assembly disclosed therein employs two curved knives spaced on opposite sides of a central collar. The knifes curve in the same circumferential direction about a central axis. Numerous knife assemblies are arranged in spaced relationship along an arbor, with their respective points disposed in helical relationship. The spaced knife assemblies cooperate with a fixed anvil having a plurality of grating members, to shred waste material.

The knife assemblies are arranged so that the leading edge of the point, or tooth, moves past a grating member before the curved shredding portions, thereby forcing material towards the arbor body. Should the knife assemblies be unable to cut through the material, jamming the shredder, control means will reverse the rotation of the arbor in an attempt to unwedge the tooth. During this reversed rotation, however, no cutting or shredding can be accomplished, since the knives of the knife assemblies are all radially curved in the same circumferential direction. Consequently, the rotation of the knife assemblies must then again be reversed in an effort to cut the jamming material, since there are no secondary knives curving in opposite direction as that of the principal knives.

Another problem is encountered in industrial shredders having inwardly counterrotating clawing assemblies, when large objects are introduced into the feed bin. If the exterior surface of the material is too large, the counterrotating knife assemblies often cannot nip the object to draw the object between the knives. Consequently, the object will often ride above the counterrotating knives. Conventional shredders of the prior art have no means to reorient the objects in the feed bin when the rotation of the knife assemblies is reversed.

U.S. Pat. No. 4,538,766, discloses a knife assembly having a generally L-shaped cutting surface and an arcuate trailing edge. In one embodiment, a plurality of knife assemblies are spaced along a drive shaft and rotated to turn between calibrated slots defined by a stationary element. The knife assemblies include one knife blade only, and the cutting action is similar to that disclosed in U.S. Pat. No. 4,678,126. A second embodiment employing knife blades arranged on outwardly counterrotating shafts is also disclosed. The material is not cut between the knife assemblies of the two counterrotating shafts, but is instead comminuted between the knife assemblies and a stationary element, as in the first embodiment. Even if the rotation of the drive shafts is reversed, no comminution between the counterrotating knife assemblies is possible, since the knives curve in only one direction, defining a single cutting surface. This limits the cutting action to be in this one direction only, and in cooperation with a stationary member.

U.S. Pat. No. 2,551,049, discloses a multiblade rotary gang for a mincing operation in a meat cutting machine. The two-blade cutters disclosed in one embodiment employ two straight-edged blades spaced around the periphery of a center piece. In a second embodiment, the two-blade cutter employs conventional, curved cutting edges which extend radially and curve in the same circumferential direction around the center piece.

Other knife assemblies previously used, employ various curved shapes defining a cutting edge. No known assemblies, however, include a secondary knife curved in the opposite direction as the principal knife for accomplishing continued cutting and reorientation of the material when the rotation of the assemblies is reversed.

SUMMARY OF THE INVENTION

Briefly described, the present invention includes a knife assembly having an arcuate mounting flange and adapted to be received on a drive shaft of a shredder. The knife assembly includes a first knife integrally secured to the mounting flange, and extending radially, outwardly therefrom and terminating at a first distal point or first tip. The first knife includes an inner, concave cutting surface which extends along the inner edge from the tip around the concave portion and continuing along the mounting flange. Also extending outwardly from the mounting flange is a second knife having a radially extending portion which terminates in a second distal point or second tip, and includes a first concave cutting surface which extends from the second tip along the inner edge and continues along a portion of the proximal end of the first knife. The second knife also includes a third distal point or third tip extending in the opposite direction from the first distal point, and defining a concave cutting surface which is opposed from the first concave cutting surface of the second knife. The mounting flange of the knife assembly additionally defines a series of spaced apertures therethrough, for receiving retaining pins or anchor means.

The preferred embodiment of the knife assembly is incorporated into an industrial shredder. The shredder includes a housing defining a receiving bin with side walls, and being open at its upper portion. Disposed longitudinally within the receiving bin are a pair of spaced clawing assemblies. The clawing assemblies include drive shafts which are driven inwardly in a counterrotating relationship. The drive shafts include spaced retaining rings securely mounted thereto, to which the mounting flanges of the knife assemblies are attached, using retaining pins. The knife assemblies are spaced down the perimeter of and mounted onto the drive shafts so that the first distal point of the first knife and the second distal point of the second knife are directed inwardly toward the opposed drive shaft, respectively. The third distal point of each respective knife assembly, therefore, projects outwardly, away from the respective, opposed drive shaft. Disposed below the clawing assemblies is a refuse bin which receives the shredded material. A conveyor is preferably positioned within the lower portion of the refuse bin to carry the shredded material away from the shredder.

A second embodiment of the present invention includes an annular retaining flange having first and second knives, as described in the preferred embodiment, and also including a third knife extending radially outwardly from the retaining flange and terminating in a fourth distal point directed in an opposite circumferential direction as that of the first distal point of the first knife.

A third embodiment of the present invention includes the elements of the knife assembly described in the second embodiment, wherein the third knife also includes an oppositely directed fifth distal point, extending in the same circumferential direction as that of the first distal point of the first knife.

A fourth embodiment of the knife assembly of the present invention includes an annular mounting flange with a pair of oppositely disposed knives along the periphery of the flange. The knife of this embodiment is symmetrical, each knife being a mirror image of the other, and includes a pair of circumferentially extending portions terminating in oppositely extending distal points. The knife assemblies of each embodiment are adapted to be received on the drive shaft of the above-described shredder.

Accordingly, it is an object of the present invention to provide a knife assembly that is efficient in operation, durable in structure, and inexpensive to manufacture.

Another object of the present invention is to provide a knife assembly which includes two principal distal points curved circumferentially in one direction, and one secondary distal point curved circumferentially in an opposite direction.

Another object of the present invention is to provide a knife assembly which is adapted to be removably secured to a drive shaft for rotation with the shaft about the axis of said shaft.

Another object of the present invention is to provide a knife assembly which includes a first knife having a concave cutting surface, and a second knife having two concave cutting surfaces oppositely disposed from one another.

Another object of the present invention is to provide a knife assembly which includes a first knife radially curving to form a first distal point, and a second knife radially curving to form a second distal point and radially curving in an opposite direction to form a third distal point.

Another object of the present invention is to provide a shredder which utilizes rotating knife assemblies to cut material in each direction of rotation.

Another object of the present invention is to provide a shredder which includes means to reposition material when the shredder is operated in a reversed rotational mode.

Other objects, features and advantages of the present invention will become apparent from the following description when taken in conjunction with the accompanying drawings, wherein like characters of reference designate corresponding parts throughout the several views.

DESCRIPTION OF THE PREFERRED EMBODIMENTS

Figure 1:
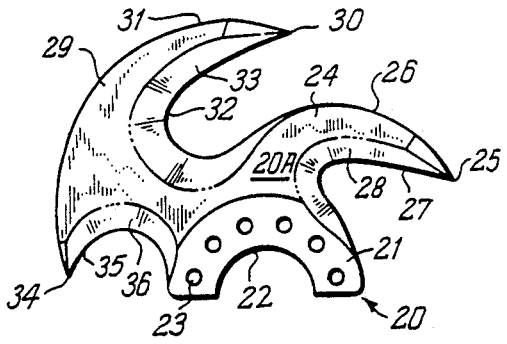
FIG. 1 is an elevated view of the knife assembly of the present invention.

Referring now in detail to the embodiments chosen for the purpose of illustrating the present invention, numeral 20 in FIG. 1 denotes generally, a knife assembly having an arcuate, flat, mounting flange 21 defining arcuate, inner abutting surface 22. Mounting flange 21 defines apertures 23 spaced along flange 21 outwardly from arcuate surface 22. Knife assembly 20 includes a first knife 24 which is preferably, integrally molded to mounting flange 21 and extends radially outwardly from flange 21 and curves approximately about a circumference of an imaginary circle around flange 21, as depicted in FIG. 1. First knife 24 tapers toward a first distal point or tip 25, having a curved trailing edge 26. First knife 24 also defines a concave inner surface 27. Inner surface 27 includes an angled, concave, inner cutting surface 28 extending from tip 25 and around inner surface 27 towards mounting flange 21. As shown in FIG. 1, knife 24, therefore, extends radially outwardly from flange 21 and curves approximately circumferentially around flange 21. Knife assembly 20 also includes second knife 29 extending radially outwardly from flange 21. Second knife 29 curves circumferentially outwardly from flange 21 along an imaginary circle around flange 21, and tapers to define a second distal point or tip 30, having a curved trailing edge 31. Second knife 29 defines inner concave surface 32 and inner, angled, concave cutting surface 33 which extends from tip 30 around inner surface 32 and terminates at the rearward portion of edge 26. Second knife 29 also tapers to form third distal point or tip 34, which also extends in a direction circumferentially around flange 21. As shown in FIG. 1, edge 31 extends from second distal point 30 to third distal point 34. Second knife 29 also includes inner, concave surface 35 which defines inner, angled, concave cutting surface 36. Cutting surface 36 extends from third distal point 34 around inner surface 35 to mounting flange 21. Third distal point 34 extends in a direction circumferentially around flange 21, and in the opposite circumferential direction as both first distal point 25 and second distal point 30. Knife assembly 20 is preferably cast molded of hardened steel in order to withstand pressures of approximately 150,000 lbs./square inch, at each distal point. As will be described in more detail hereinafter, knife assembly 20 is adapted to be incorporated into a shredder for comminuting industrial waste.

Figure 2:
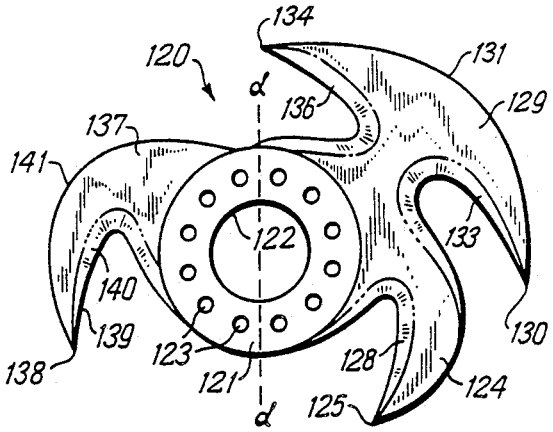
FIG. 2 is an elevated view of another embodiment of a knife assembly of the present invention.

A second embodiment of the knife assembly is depicted in FIG. 2, and includes identical elements as those described in reference to the first embodiment, having a first knife 124 defining first distal point 125 and inner, concave cutting surface 128, and a second knife 129 defining second distal point 130 and inner, concave cutting surface 133, and also defining third distal point 134 and inner, concave cutting surface 136. The mounting flange 121 of knife assembly 120, however, is annular, defining central aperture 122 and spaced apertures 123 therethrough. Arcuate camming surface 131 extends between distal points 130 and 134. The knife assembly 120 of the second embodiment, however, also includes third knife 137 extending radially outwardly from mounting flange 122. Knife 137 curves circumferentially around flange 122 and defines fourth distal point 138 and inner, concave edge 139. Concave, angled cutting surface 140 is defined along edge 139, and extends from fourth distal point 138 around edge 139 and terminates adjacent to mounting flange 121. Arcuate camming surface 141 extends from tip 138 rearwardly to flange 121. As depicted in FIG. 2, fourth distal point 138 extends circumferentially in the same direction as third distal point 134 and in the opposite circumferential direction as first distal point 125 and second distal point 130.

Figure 3:
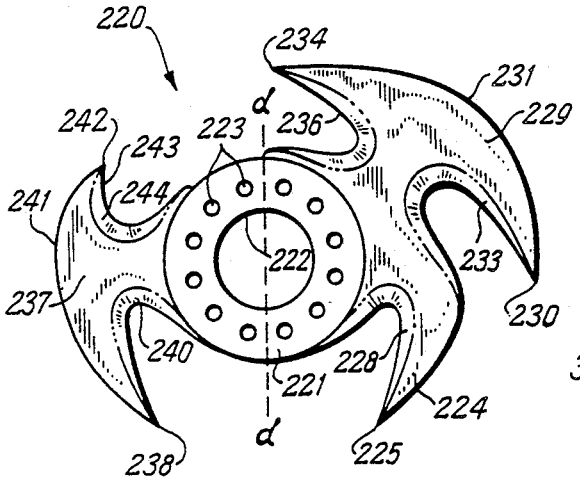
FIG. 3 is an elevated view of another embodiment of a knife assembly of the present invention.

A third embodiment of the present invention is shown in FIG. 3, and includes elements identical to those described in FIG. 2, including annular mounting flange 221, defining central aperture 222 and spaced apertures 223 therethrough. Knife assembly 220 includes first knife 224, defining first distal point 225 and inner, concave cutting surface 228. Second knife 229 defines second distal point 230 and inner, concave cutting surface 233. Second knife 229 also defines third distal point 234 and inner, concave cutting surface 236. Arcuate camming surface 231 extends from second distal point 230 to third distal point 234. Knife assembly 220 also includes third knife 237 which defines fourth distal point 238 and inner, concave cutting surface 240. Additionally, however, knife assembly 220 also defines fifth distal point 242 which opposes fourth distal point 238. Arcuate camming surface 241 extends between fourth distal point 238 and fifth distal point 242. Third knife 237 also defines inner, concave edge 243 and inner, concave cutting surface 244 which extends along edge 243 from fifth distal point 242 to mounting flange 221. As shown in FIG. 3, fifth distal point 242 extends circumferentially in the opposite direction as third distal point 234 and fourth distal point 238 and in the same circumferential direction as first distal point 225 and second distal point 230.

Figure 4:
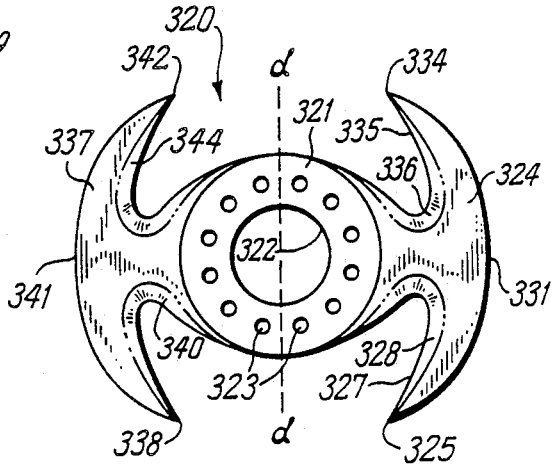
FIG. 4 is an elevated view of another embodiment of a knife assembly of the present invention.

A fourth embodiment of the knife assembly of the present invention is depicted in FIG. 4, and includes knife assembly 320, having annular mounting flange 321 which defines central mounting aperture 322 and spaced apertures 323 therethrough. Extending radially outwardly from mounting flange 321 is first knife 324 which defines first distal point 325 and inner, concave edge 327. Inner, angled cutting surface 328 extends from first distal point 325 along concave edge 327 to mounting flange 321. First distal point 325 extends circumferentially about mounting flange 321 as shown in FIG. 4. First knife 324 also defines second distal point 334 and inner, concave edge 335. Inner, angled cutting surface 336 extends along concave edge 335 from point 334 to mounting flange 321. Second distal point 334 extends circumferentially about annular flange 321 in the opposite circumferential direction as that of first distal point 325. Arcuate camming surface 331 extends from first distal point 325 to second distal point 334.

Knife assembly 320 also includes second knife 337. Since knife assembly 320 is symmetrical about axis $\alpha$, second knife 337 is identical to first knife 324 in all respects. Second knife 337 thus defines third distal point 338 and angled, inner, concave cutting surface 340 extending from third distal point 338 to annular mounting flange 321. Third knife 337 also defines fourth distal point 342 and inner, angled, concave cutting surface 344, which extends from fourth distal point 342 to annular flange 321, as shown in FIG. 4. Arcuate camming surface 341 extends from third distal point 338 to fourth distal point 342. As shown in FIG. 4, third distal point 338 extends circumferentially around annular flange 321 in the same circumferential direction as that of second distal point 334 and in the opposite circumferential direction as that of first distal point 325. Fourth distal point 342 extends in the same circumferential direction as that of first distal point 325 and in the opposite circumferential direction as that of second distal point 334. As in the previous embodiments, first knife 324 and second knife 337 are preferably integrally cast of hardened steel along with annular mounting flange 321, as a single unit.

Figure 5:
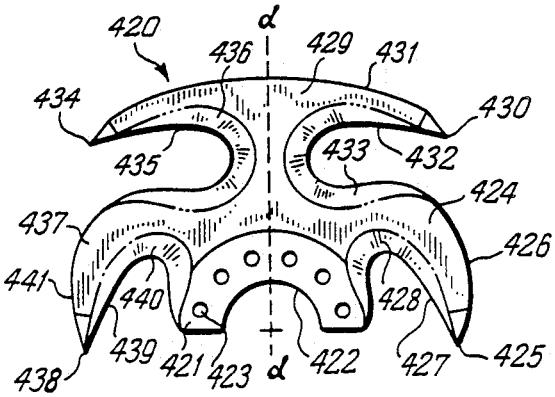
FIG. 5 is an elevated view of another embodiment of a knife assembly of the present invention.

A fifth embodiment of the knife assembly of the present invention is depicted in FIG. 5, and and includes knife assembly 420 having an arcuate, flat, mounting flange 421 defining arcuate, inner abutting surface 422. Mounting flange 421 defines apertures 423 spaced along flange 421 outwardly from arcuate surface 422. Extending radially, outwardly from mounting flange 421 is first knife 424 which tapers toward a first distal point or tip 425 having a curved trailing, outer edge 426. First knife 424 also defines a concave inner surface 427. Inner, angled cutting surface 428 extends from first distal point 425 along concave edge 427 to mounting flange 421. First distal point 425 extends circumferentially about mounting flange 421, as shown in FIG. 5. Knife assembly 420 also includes second knife 429 extending radially outwardly from flange 421. Second knife 429 curves approximately circumferentially outwardly from flange 421 along an imaginary circle around flange 421, and tapers to define a second distal point or tip 430 and having a curved trailing edge 431. Second knife 429 defines inner, concave surface 432 and inner, angled, concave cutting surface 433, which extends from tip 430 around inner surface 432 and terminates at the rearward portion of edge 426 on first knife 424. First distal point 425 and second distal point 430 extend circumferentially about flange 421 in the same circumferential direction.

Second knife 429 also tapers to form a third distal point or tip 434, which also extends in a direction circumferentially around flange 421. As shown in FIG. 5, edge 431 extends from second distal point 430 to third distal point 434. Second knife 429 also includes inner, concave surface 435, which defines inner, angled, concave cutting surface 436. Cutting surface 436 extends from third distal point 434 around inner surface 435 to mounting flange 421. Third distal point 434 extends in a direction circumferentially around flange 421 in the opposite circumferential direction as both first distal point 425 and second distal point 430.

The knife assembly 420 of the fifth embodiment, however, also includes a third knife 437 extending radially outwardly from mounting flange 421. Knife 437 curves circumferentially around flange 421 and defines fourth distal point 438 and inner, concave edge 439. Concave, angled cutting surface 440 is defined along edge 439 and extends from fourth distal point 438 around edge 439 and terminates adjacent to mounting flange 421. Arcuate camming surface 441 extends from tip 438 rearwardly to the proximal portion of cutting surface 436, as shown in FIG. 5. Fourth distal point 438 extends circumferentially in the same direction as third distal point 434 and in the opposite circumferential direction as first distal point 425 and second distal point 430. As shown in FIG. 5, the structure of knife assembly 420 is symmetrical about axis $\alpha$.

As used herein, the terms "circumferential" when used to describe the general orientation of the knife points, are not meant to imply that the knives extend circumferentially about the mounting flange along a perfect circle about the flange. These terms are meant only to describe the general orientation of the knife points about the mounting flange. The present invention is not limited to the exact curvature of the knife points. The knife assemblies can be manufactured with the knife points at a greater curvature or at a lesser curvature than that depicted in the accompanying drawings, and still perform satisfactorily and in accordance with the invention disclosed herein.

Figure 6:
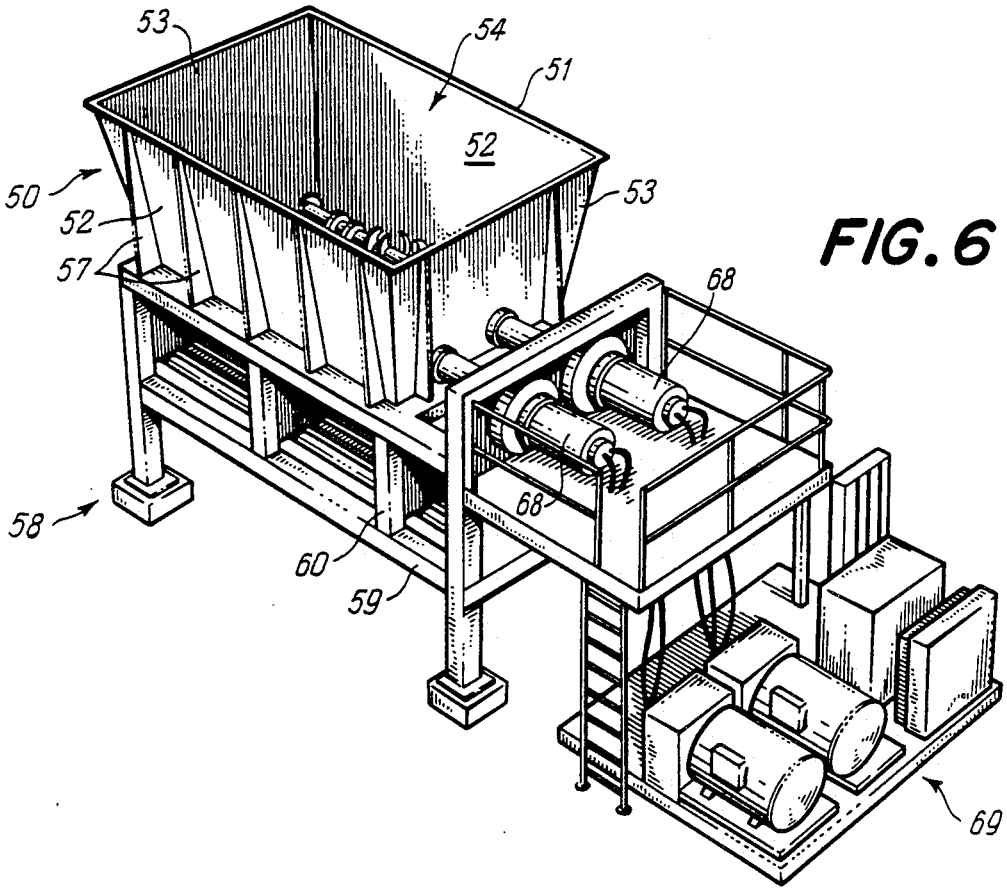
FIG. 6 is a perspective view of the shredder of the present invention.
Figure 7:
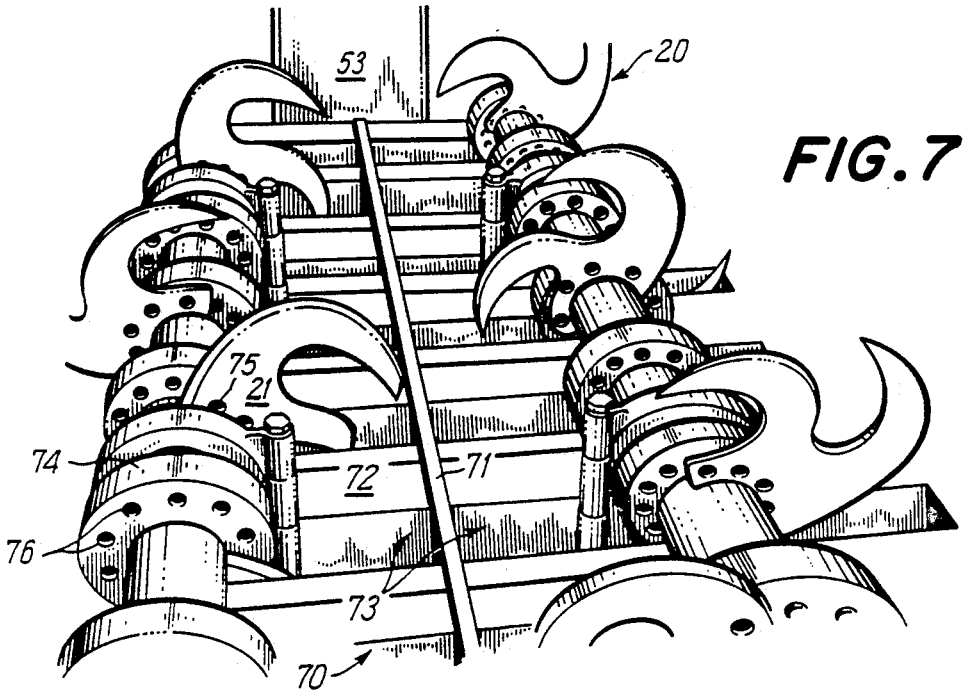
FIG. 7 is a perspective view of one embodiment of the knife assemblies incorporated into the shredder of the present invention.
Figure 8:
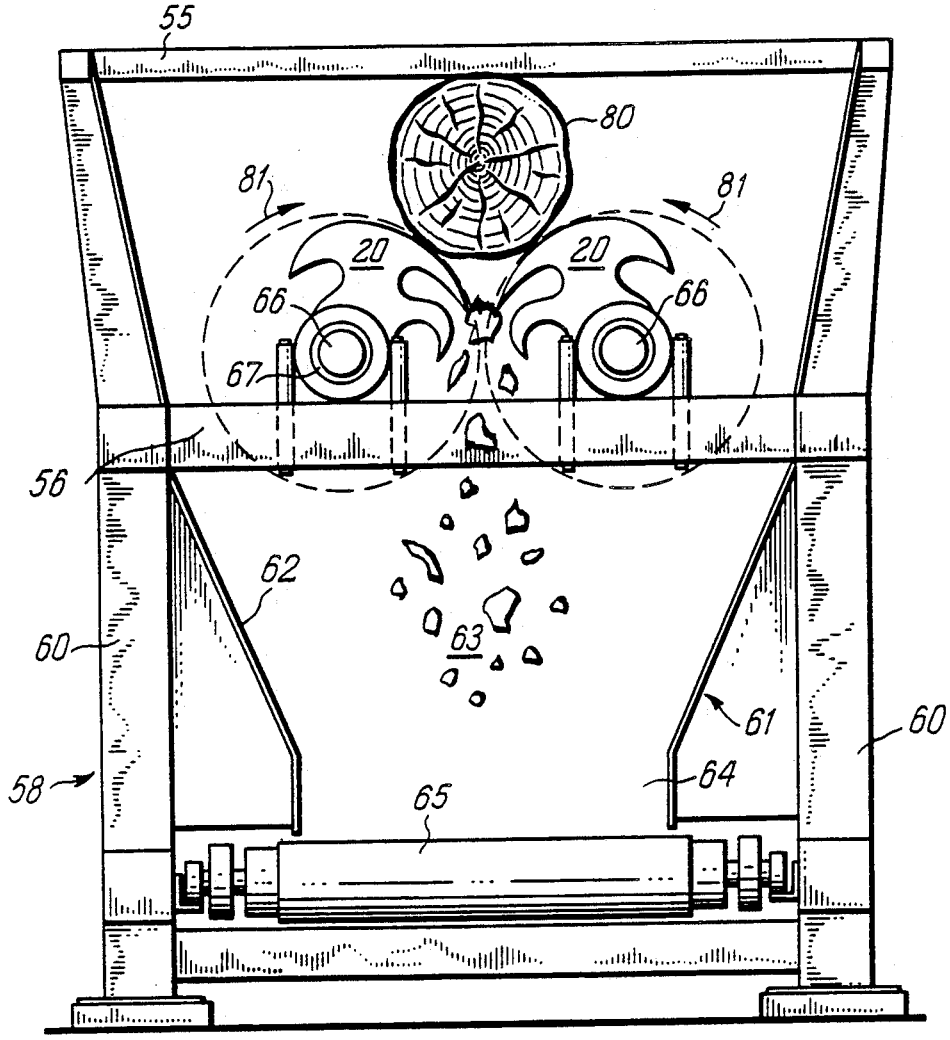
FIG. 8 is a cross-sectional view of the shredder of the present invention.

The knife assemblies of the present invention are incorporated into an industrial refuse shredder. Refuse shredder 50 is illustrated in FIGS. 6, 7, and 8, and includes upstanding, longitudinally disposed housing 51 having upstanding, inwardly angled, rectangular side walls 52 and upstanding, inwardly angled, rectangular end walls 53 joined at their respective edges thereto to form a receiving bin 54. Bin 54 defines an open top portion 55 with side walls 52 and end walls 53 tapering inwardly to define a refuse passageway 56 along the lower edges of receiving bin 54. Upstanding, angled support standards 57 are welded along the outer periphery of side walls 52 and end walls 53 for structural support. FIG. 6 depicts housing 51 supported by frame assembly 58 which includes longitudinally square-steel beams 59 and spaced, upstanding, support square-steel members 60 welded thereto, to support housing 51. It is obvious to those skilled in the art, however, that any satisfactory frame assembly, such as frame assembly 58 can be utilized to support housing 51, and the other enumerated elements of shredder 5, in order to accomplish the results of the shredder 50. Disposed below refuse passageway 56 of receiving bin 54 is refuse bin 61 which includes inwardly angled, flat, planer, side walls 62 and inwardly angled, flat planar end walls 63. Walls 62 and 63 angle inwardly to form passageway 64 in the lower portion of refuse bin 61. Refuse bin 61 is supported by frame assembly 58 to be disposed over conveyor 65. Conveyor 65 is positioned below refuse bin 61 to receive the material which accumulates in refuse bin and to transport the refuse material away from shredder 50. The conveyor 65 can be any conventional conveying means such as a synthetic rubber belt journaled on idlers or a metal pan line, well known in the art.

Longitudinally disposed within the lower portion of receiving bin 54 and just above refuse passageway 56 are a pair of spaced, longitudinally extending, drive shafts 66 which are journaled at their end portions by journals 67 mounted in end walls 53. Drive shafts 66 extend outwardly from one end wall 53, each drive shaft 66 engaging a respective hydraulic motor 68. Hydraulic motors 68 are carried by any common frame assembly, such as frame assembly 58. Hydraulic motors 68 are powered through conventional hydraulic lines by any conventional hydraulic pumping assembly, such as pumping assembly 69. It is not critical to the shredder of this invention that the drive shafts be powered by any particular power means, however, a conventional hydraulic motor assembly providing 100 horsepower is found to work well in most industrial applications. An air cooled diesel motor can also be utilized for satisfactory results.

Disposed below drive shafts 66 is cutting platform assembly 70. Cutting platform assembly 70 includes longitudinally extending central beam 71 and transversely extending, square-steel, spaced, cross-members 72. Cross-members 72 are positioned in spaced relationship within cutting platform assembly 70 to define slots 73 therebetween. Cutting platform assembly 70 is received in horizontal, laterally disposed relationship within housing 51, below drive shafts 66 by being supported by suitable flanges (not shown) around the inner periphery of the lower portion of receiving bin 54. Further, transverse cross-members 72 can include journal means (not shown) for additional journaling to drive shafts 66.

Secured to each drive shaft 66 in spaced relationship are annular support rings 74. Support rings 74 are preferably welded in fixed relationship to drive shafts 66 in order to turn therewith. As shown in FIG. 7, knife assemblies such as knife assembly 20, are mounted to support rings 74 by any suitable anchor means, such as externally threaded bolts 75, which pass through apertures 23 and into internally threaded bores 76 of retaining ring 74. Preferably, the heads of bolts 75 are recessed into mounting flanges 21.

As shown in FIG. 7, numerous knife assemblies 20 are mounted along the periphery of drive shafts 66 on retaining rings 74, in spaced relationship so that as drive shafts 66 are rotated, knife assemblies 20 rotate therewith, within slots 73. The orientation of the respective knife assemblies 20 about drive shafts 66 is preferably such that the first distal points 25 and second distant points 30 of each respective knife assembly 20 are arranged in staggered relationship.

In operation, an object such as tree trunk 80 is fed into receiving bin 54 of housing 51 to rest upon knife assemblies 20. As the hydraulic motors are actuated, drive shafts 66 are driven rotationally so that the knife assemblies 20 mounted thereon turn inwardly in the direction of arrows 81. The object 80 is drawn between the knives of knife assemblies 20 where knife assemblies 20 claw the object as assemblies 20 rotate through slots 73 of cutting platform assembly 70. Thus, the object 80 is shredded or comminuted into small pieces which fall through slots 73 and into refuse bin 61 and ultimately onto conveyor belt 65. The shredded refuse is carried by conveyor 65 out of shredder 50, for disposal. In practical operation, however, the principal knife points, first distal point 25 and second distal point 30 often become jammed into an object such as object 80, therefore jamming the knife assemblies 20 and stoping the inward rotation of drive shafts 66. When this condition occurs, the control means (not shown) of motor 68 automatically reverses the rotation of drive shafts 66 to free the knife assemblies 20 from object 80. During this reverse rotation, third distal knife point 34 is rotated into object 80 and repositions object 80 against one side wall 52 and the portion of cutting platform assembly 70, adjacent thereto. During this reversed rotational mode, third distal point 34 will claw into object 80 and continue the comminution process. Thus, shredder 50 can be operated in either an inwardly directed rotational mode or an outwardly directed, reverse rotational mode, to comminute the material.

Another advantage of incorporating oppositely opposed knife points, such as third distal point 34, is that as the rotation of drive shafts 66 is reversed to rotate knife assemblies 20 outwardly, third distal point 34 can be used to turn or reposition object 80 within receiving bin 54. When object 80 is turned or repositioned by reversing the rotation of drive shaft 66, the operator can, again, reverse the rotation of drive shafts 66, turning knife assemblies again inwardly, thereby using the principal knife points, first distal point 25 and second distal point 30, to again claw the object. In many cases, the object can be repositioned in this manner until the knife points can cut through the object.

Additionally, the surface area of some objects is sufficiently large so that the objects merely ride upon the inwardly rotating knife assemblies 20, rather than being drawn down between the respective knife points of knife assembly 20. Having a secondary, or opposed, knife point, such as knife point 34, allows the operator to reverse the motor of the machine and try to reposition the object within the receiving bin until the object can be nipped between the inwardly counterrotating knife points and comminuted therebetween. In practice, the operator of the shredder 50 frequently reverses, then reverses again, the rotational mode of drive shafts 66 in order to comminute the material.

The appropriate control means to automatically sense a jamming condition between knife assemblies 20 and to reverse the rotation of drive shafts 66 is well known in the art, is conventional, and therefore is not discussed in further detail herein.

Of course, the various embodiments of the knife assemblies, as depicted in FIGS. 1, 2, 3, 4 and 5, can alternatively or in combination be incorporated onto drive shaft 66 of shredder 50. The retaining rings 74 of drive shafts 66 are adapted to receive both the annular mounting flange, such as flanges 121, 221, 321 and 421, as well as arcuate mounting flange 21 of the first embodiment. Flanges 21 of the first embodiment can also be annular instead or arcuate, as desired.

It will further be obvious to those skilled in the art that many variations may be made in the above embodiments here chosen for the purpose of illustrating the present invention, and full result may be had to the doctrine of equivalents without departing from the scope of the present invention, as defined by the appended claims.

What is claimed is:

1. A knife assembly for a shredder, comprising:

(a) a mounting means;

(b) a first knife secured at its proximal end to said mounting means and extending radially outwardly therefrom to form a first distal point, said first knife defining a first cutting surface between said first distal point and said mounting means;

(c) a second knife secured at its proximal end to said mounting means, said second knife also being joined at its proximal end to said proximal end of said first knife and extending radially outwardly from said mounting means to form a second distal point, and defining a second cutting surface extending in the same cutting direction as said first cutting surface between said second distal point and said first knife; said second knife extending radially outwardly from said mounting means to form a third distal point and defining a third cutting surface between said third distal point and said mounting means, whereby said second distal point extends in the opposite circumferential direction from said third distal point.

2. The knife assembly defined in claim 1, wherein said first distal point of said first knife and said second distal point of said second knife extend radially outwardly from said mounting means in the same circumferential direction.

3. The knife assembly defined in claim 1, wherein said cutting surfaces are substantially concave.

4. The knife assembly defined in claim 1, wherein said first knife and said second knife are integrally formed along with said mounting means.

5. The knife assembly defined in claim 1, wherein said mounting means includes an arcuate abutment surface along one side for receiving a drive shaft, and defines spaced apertures passing therethrough for receiving anchor means.

6. The knife assembly defined in claim 1, and a third knife secured at its proximal end to said mounting means and extending radially outwardly therefrom to form a fourth distal point extending in the same circumferential direction as said third distal point.

7. The knife assembly defined in claim 6, whereby said third knife extends radially outwardly to define a fifth distal point extending in the opposite circumferential direction as said fourth distal point.

8. A shredder, comprising:

(a) housing means defining a receiving bin for receiving material to be shredded;

(b) clawing means disposed within said housing means for shredding said material, said clawing means including a drive shaft journaled at each end portion by said housing means and clawing means secured in spaced relationship along the periphery of said drive shaft, said clawing means including mounting means for attaching said clawing means to said drive shaft, a first knife secured at its proximal end to said mounting means and extending radially outwardly therefrom to define a first distal point, a second knife secured at its proximal end to said mounting means, said second knife also being joined at its proximal end to said proximal end of said first knife and extending radially outwardly from said mounting means to define a second distal point extending in the same circumferential directional as said first distal point, said second knife extending radially outwardly from said mounting means to form a third distal point, whereby said second distal point extends in the opposite circumferential direction from that of said third distal point; and (c) drive means attached to one end of said drive shaft for rotating said drive shaft.

9. The shredder defined in claim 8, wherein said housing means includes a refuse bin disposed below said clawing means.

10. The shredder defined in claim 9, and conveyor means disposed within said refuse bin and projecting outwardly therefrom for transporting said material out of said refuse bin.

11. The shredder defined in claim 8, wherein said receiving bin includes upstanding side walls which slope inwardly toward said clawing means, said walls defining an opening.

12. A knife assembly for a shredder, comprising:

(a) a mounting means for rotation about an axis;

(b) a first knife secured at its proximal end to said mounting means for rotation with said mounting means about said axis, said first knife extending radially outwardly from said mounting means to form a first distal point protruding in the direction of rotation, said first knife defining a first, outer surface and a first inwardly facing cutting surface between said first distal point and said mounting means; and (c) a second knife circumferentially spaced from said first knife and secured at its proximal end to said mounting means for rotation with said mounting means about said axis, said second knife being integrally joined at its proximal end to the proximal end of said first knife and extending radially outwardly from said mounting means to form a second distal point protruding in the direction of rotation, a portion of said second knife overlying and being spaced from said first knife to provide an opening therebetween, said second knife also defining a second inner cutting surface, said second knife extending radially outwardly from said mounting means to form a third distal point, said third distal point extending in a direction opposite to the direction of rotation, said second knife defining a cutting surface between said third distal point and said mounting means.

13. A knife assembly for a shredder, comprising:

(a) a mounting flange;

(b) a first knife secured at its proximal end to said mounting flange and extending radially outwardly therefrom to form a first distal point, said first knife defining a first cutting surface between said first distal point and said mounting flange and also defining a first trailing edge;

(c) a second knife secured at its proximal end to said mounting flange and extending radially outwardly therefrom to form a second distal point which overlaps and is spaced from said first trailing edge, and defining a second cutting surface between said second distal point and said mounting flange; said second knife extending radially outwardly from said mounting flange to form a third distal point and defining a cutting surface between said third distal point and said mounting flange, whereby said second distal point extends in the opposite circumferential direction from said third distal point.

14. The knife assembly defined in claim 13, and a third knife secured at its proximal end to said mounting flange and extending radially outwardly therefrom to form a fourth distal point extending in the same circumferential direction as said third distal point.

15. The knife assembly defined in claim 14, said third knife extending radially outwardly to define a fifth distal point extending in the opposite circumferential direction as said fourth distal point.

16. The knife assembly defined in claim 14, wherein said knife assembly is substantially symmetrical about a vertical axis.

* * * * *